US005469246A

United States Patent [19]

Sunaga et al.

[11] Patent Number: 5,469,246

[45] Date of Patent: Nov. 21, 1995

[54] DEVELOPING APPARATUS USING MONOCOMPONENT DEVELOPER

[75] Inventors: Takayuki Sunaga; Akihiko Kato; Takashi Sakamoto; Hideaki Miyata, all of Ebina, Japan

[73] Assignee: Fuji Xerox Co., Ltd., Tokyo, Japan

[21] Appl. No.: 321,312

[22] Filed: Oct. 11, 1994

[30] Foreign Application Priority Data

Jan. 5, 1994 [JP] Japan ..... 6-000093

[51] Int. Cl.[6] ..... G03G 15/09

[52] U.S. Cl. ..... 355/251; 118/657; 355/253; 355/261; 355/265

[58] Field of Search ..... 355/245, 251, 355/252, 253, 261, 265; 118/653, 656, 657, 658

[56] References Cited

U.S. PATENT DOCUMENTS

| | | | |
|---|---|---|---|
| 4,610,531 | 9/1986 | Hayashi et al. | 355/265 X |
| 5,070,812 | 12/1991 | Yamaji | 118/658 |
| 5,177,536 | 1/1993 | Watanabe et al. | 355/251 |
| 5,187,523 | 2/1993 | Osawa | 355/251 |
| 5,190,843 | 3/1993 | Noda et al. | 355/253 X |
| 5,338,894 | 8/1994 | Uchiyama et al. | 118/653 |
| 5,359,397 | 10/1994 | Yamaji | 355/251 |

FOREIGN PATENT DOCUMENTS

| | | |
|---|---|---|
| 61-223769 | 10/1986 | Japan . |
| 63-146064 | 6/1988 | Japan . |
| 3-284771 | 12/1991 | Japan . |
| 4-97177 | 3/1992 | Japan . |

*Primary Examiner*—Sandra L. Brase
*Attorney, Agent, or Firm*—Oliff & Berridge

[57] ABSTRACT

A developing apparatus using monocomponent developer comprising: a developer application unit for having a thin coat of monocomponent magnetic developer of a constant thickness applied to and held over a developer carrying body, the thin coat on the developer carrying body being moved close to an image carrying member; a transfer unit for getting an alternating electric field applied between the developer carrying body and the image carrying member to transfer aerially the thin coat of monocomponent magnetic developer from the developer carrying body to the image carrying member; and a developing unit for developing a latent image on the image carrying member using the transferred developer; wherein the following conditions are met:

$$11\times10^5/Vp\text{-}p \leqq V_D \leqq 13\times10^5/Vp\text{-}p$$

$$3\times10^5/Vp\text{-}p \leqq G \leqq 5\times10^5/Vp\text{-}p$$

where, $V_D$ stands for the dark developing potential in volts for the image developing region of the developing apparatus, Vp-p for the peak-to-peak value of the alternating electric field, and G for the gap in microns between the developer carrying body and the image carrying member.

3 Claims, 7 Drawing Sheets

DEVELOPING APPARATUS USING MONOCOMPONENT DEVELOPER

BACKGROUND OF THE INVENTION

1. Field of the Invention

The present invention relates to a developing apparatus using monocomponent magnetic developer for developing electrostatic latent images.

2. Description of the Related Art

The basic constitution of a typical developing apparatus using monocomponent developer is disclosed illustratively in Japanese Patent Laid-open No. Sho 61-223769 filed by the same applicant having filed this invention. The disclosed apparatus utilizes a semiconductive phenolic resin as the material of the sleeve for a developing roller incorporated therein.

The roller sleeve made of the semiconductive phenolic resin allowed the above apparatus to offer a distinctive advantage over the apparatuses preceding it and operating on various non-contact developing principles. That is, in recording images, the apparatus reproduced black areas more clearly, graduated shadow images more distinctly and line images more sharply than ever before.

Since then, the need has been recognized for an apparatus capable of higher image quality, i.e., an apparatus having the ability to ensure higher levels of shadow and line image reproducibility without degrading the current level of black area reproducibility. Specifically, what has been required is the capability of copying line images faithfully, i.e., the ability to minimize both toner blurs in the vicinity of characters and the gradual thickening of lines observed when one copy reproduces another copy which in turn reproduces another, and so on.

The disclosed apparatus above fails to meet the new requirements. The reason is the limitation imposed by the electric resistance value of the developing roller sleeve. Although the electric resistance value is supposed to range from $10^6$ to $10^{12}$ Ω·cm under prior art constraints, the controllable limit of the resistance value in effect when the above apparatus was proposed was $10^9$ Ω·cm. Given that resistance value of the sleeve, machine designers had to restrict the other parameters primarily to meet the need for stable manufacture of developing rollers. Although a lower gradient γ was desired of the image density characteristic curve with respect to the electrostatic image potential for image development, the high sleeve resistance value made it impossible to attain that objective.

A solution to the above problem is proposed in Japanese Patent Laid-open No. Sho 63-146064 having recourse to a device for addressing characteristics other than the electric resistance value of the sleeve. The proposed device takes note of the waveform of an alternating electric field applied both to a developing roller and to an image carrying member. What the proposed device does is to vary the relationship between two rise velocities: the velocity at which the alternating electric field is applied in the direction of promoting development (from the developing roller to the image carrying member), and the velocity at which the alternating electric field is applied in the direction of suppressing development (from the image carrying member to the developing roller).

In the above setup, however, the sleeve is not composed of the semiconductive phenolic resin but made of metal (AI, SUS, etc.). The device thus fails to resolve the problem sufficiently, due primarily to a reduced level of resistance to leaks (i.e., a wide gap between the developing roller and the image carrying member, coupled with a low peak-to-peak level of the alternating electric field).

Another solution to the above problem is proposed in Japanese Patent Laid-open No. Hei 4-97177. The proposed apparatus embodying the laid-open invention has the sleeve made of a semiconductive phenolic resin and is set to meet the condition $$ta/T \leqq 2/5$$

where, T represents the waveform period of the alternating electric field, and ta denotes the rise time in effect when the alternating electric field is applied in the direction of promoting development (from the developing roller to the image carrying member). The newly proposed apparatus is also arranged to meet the condition $$2.5\ g+750 \leqq VP\text{-}p \leqq 5\ g+2000$$

where, g stands for the gap between the developing roller and the image carrying member, and Vp-p is the peak-to-peak value of the alternating electric field. With these features, the apparatus of the latter laid-open invention has contributed to reducing both the toner blurs in the proximity of characters and the growing thickness of lines observed in copy-to-copy reproduction.

The inventors of this invention examined the techniques of the laid-open patents and came up with new findings representing improvements for still higher image quality and for minimizing irregularities induced by the sleeve of the developing roller. These findings are incorporated in the present invention which is based primarily on the constitutions described in Japanese Patents Laid-open Nos. Sho 61-223769 and Hei 4-97177.

SUMMARY OF THE INVENTION

It is therefore an object of the present invention to provide a developing apparatus using monocomponent developer for raising the level of shadow and line image reproducibility for higher image quality while maintaining the current level of black area reproducibility, the apparatus being also arranged to reduce density irregularities induced by the sleeve of the developing roller and to reinforce the leak resistance liable to be degraded correspondingly.

In carrying out the invention and according to one aspect thereof, there is provided a developing apparatus using monocomponent developer comprising: developer application means for having a thin coat of monocomponent magnetic developer of a constant thickness applied to and held over a developer carrying body, the thin coat on the developer carrying body being moved close to an image carrying member; transfer means for getting an alternating electric field applied between the developer carrying body and the image carrying member to transfer aerially the thin coat of monocomponent magnetic developer from the developer carrying body to the image carrying member; and developing means for developing a latent image on the image carrying member using the transferred developer; wherein the following conditions are met:

$$11\times10^5/Vp\text{-}p \leqq V_D \leqq 13\times10^5/Vp\text{-}p$$

$$3\times10^5/Vp\text{-}p \leqq G \leqq 5\times10^5/Vp\text{-}p$$

where, $V_D$ stands for the dark developing potential in volts for the image developing region of the developing apparatus, Vp-p for the peak-to-peak value of the alternating electric field, and G for the gap in microns between the developer carrying body and the image carrying member.

In a preferred structure according to the invention, the developer carrying body is a cylindrical body of which the circumference is covered with a semiconductive layer and which incorporates a magnet roll inside, wherein the following condition is met:

$$10^5 \leqq R \leqq 10^7$$

where, R represents the electric resistance value of the semiconductive layer in units of Ω·cm.

In another preferred structure according to the invention, the following condition is met:

$$ta/T \leqq 2/3$$

where, ta/T stands for the duty ratio of the developing apparatus, T for the period of the alternating electric field, and ta for the time in which to apply the alternating electric field for promoting development.

In operation, the apparatus of the invention has two parameters monitored in combination. One parameter is the relation between the dark developing potential $V_D$ for the image developing region of the apparatus and the peak-to-peak value (Vp-p) of the alternating electric field applied between the developer carrying body and the image carrying member. The other parameter is the gap (μm) between the developer carrying body and the image carrying member. When the two parameters are controlled within their respective ranges, the inventive apparatus raises the level of shadow and line image reproducibility while maintaining the current level of black area reproducibility. In so doing, the apparatus reduces density irregularities and reinforces the resistance to leaks.

These and other objects, features and advantages of the invention will become more apparent upon a reading of the following description and appended drawings.

DESCRIPTION OF THE PREFERRED EMBODIMENT

Figure 1:
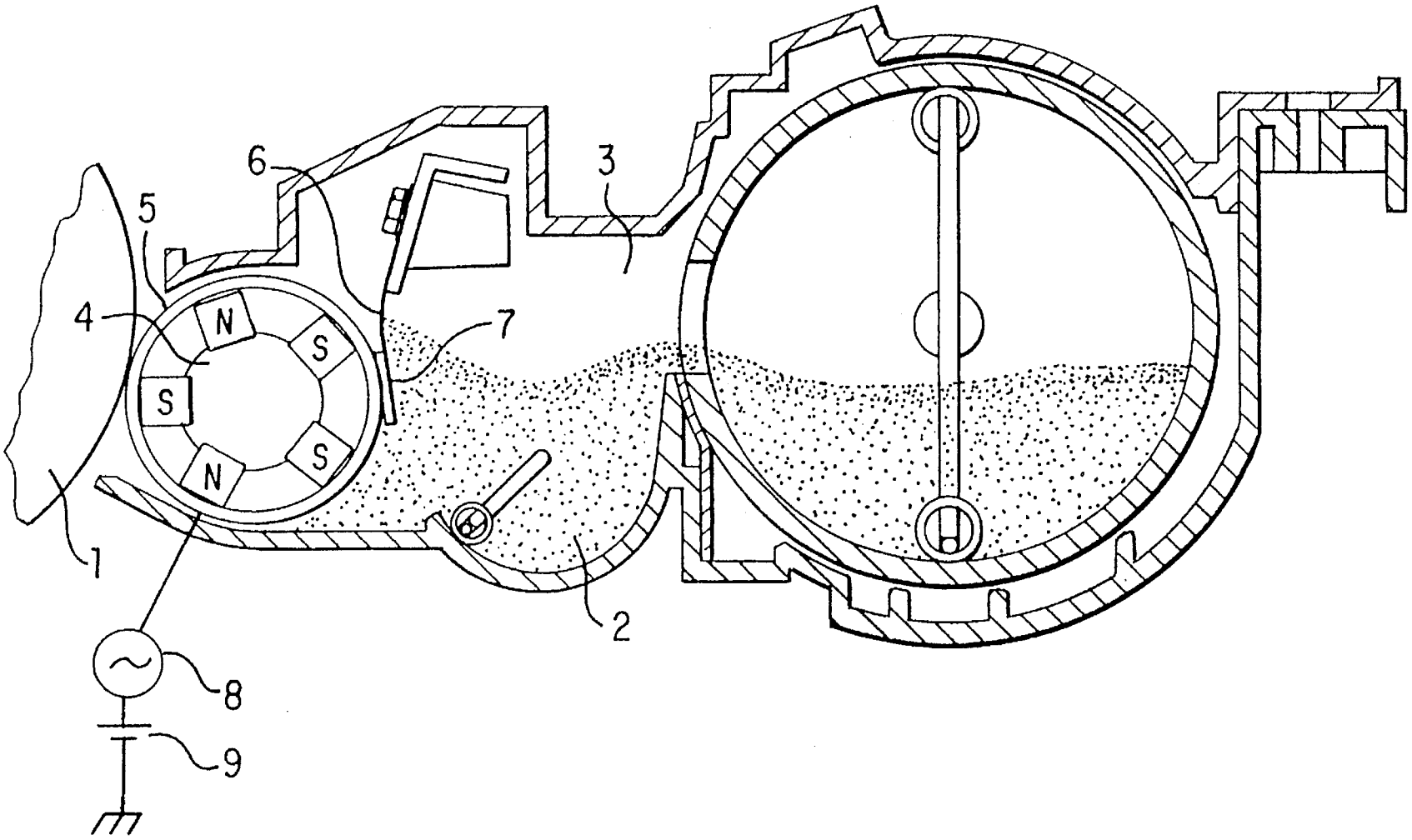
FIG. 1 is a cross-sectional view of a developing apparatus using monocomponent developer embodying the invention.

One preferred embodiment of the invention will now be described with reference to the accompanying drawings. FIG. 1 is a cross-sectional view illustrating schematically a developing apparatus using monocomponent developer embodying the invention. In FIG. 1, reference numeral 1 represents a photoconductive drum (a body that carries electrostatic latent images, called the photosensitive drum hereinafter). Charging means, not shown, charges the entire surface of the photosensitive drum before the latter is exposed. At this point, the surface potential is illustratively minus 600 volts and the background potential is illustratively minus 120 volts.

Reference numeral 3 in FIG. 1 is a hopper that accommodates monocomponent magnetic toner 2 (or simply called the toner). The toner 2 contains 48 wt % of magnetic powder. A magnet roll 4 incorporated in a sleeve 5 has N- and S-poles arranged alternately in the circumferential direction. The magnet roll 4 is attached fixedly to a frame, not shown. The sleeve 5 is a phenolic resin cylinder with a wall thickness of 1.5 mm and having a resistivity value of $4.2\times10^6$ Ω·cm. The sleeve 5 is a semiconductive sleeve (i.e., toner carrying body) that has an average surface roughness (Rz) of 8.5 μm or more measured at 10 points under JIS (Japanese Industrial Standards) provisions. The sleeve 5 is positioned opposite to the photosensitive drum 1 with a predetermined gap provided therebetween, the sleeve being supported in a pivotably rotatable manner.

Reference numeral 6 in FIG. 1 is a developer trimming member made of non-magnetic stainless steel (SUS 304 CSP ¾H) and having a thickness of 0.1 mm. The developer trimming member 6 is tipped in vulcanized fashion with a silicone rubber part 7 with a hardness of 50° and having a thickness of 1 mm. As shown in FIG. 1, the silicone rubber part 7 is brought into contact with the sleeve 5 at the three-o'clock position of the latter (perpendicular to the sleeve surface) under the force of 90 g/cm.

The surface roughness of the sleeve 5 is thus balanced with the contacting force of the developer trimming member 6 against the sleeve 5. When an appropriate balance is achieved, the amount of the toner 2 applied to the sleeve surface after restriction by the developer trimming member 6 (7) is 1.2 mg/cm$^2$ per unit area of the semiconductive sleeve 5.

In experiments, the embodiment of the above-described constitution was set up within a copier so that the gap between the semiconductive sleeve 5 and the photosensitive drum 1 was 250 μm or less. In this setup, an AC power source 8 and a DC power source 9 supplied the sleeve 5 with a DC biased AC voltage having a frequency of 2.4 kHz, a peak-to-peak voltage of 2000 V and a DC component of minus 250 V.

Figure 2:
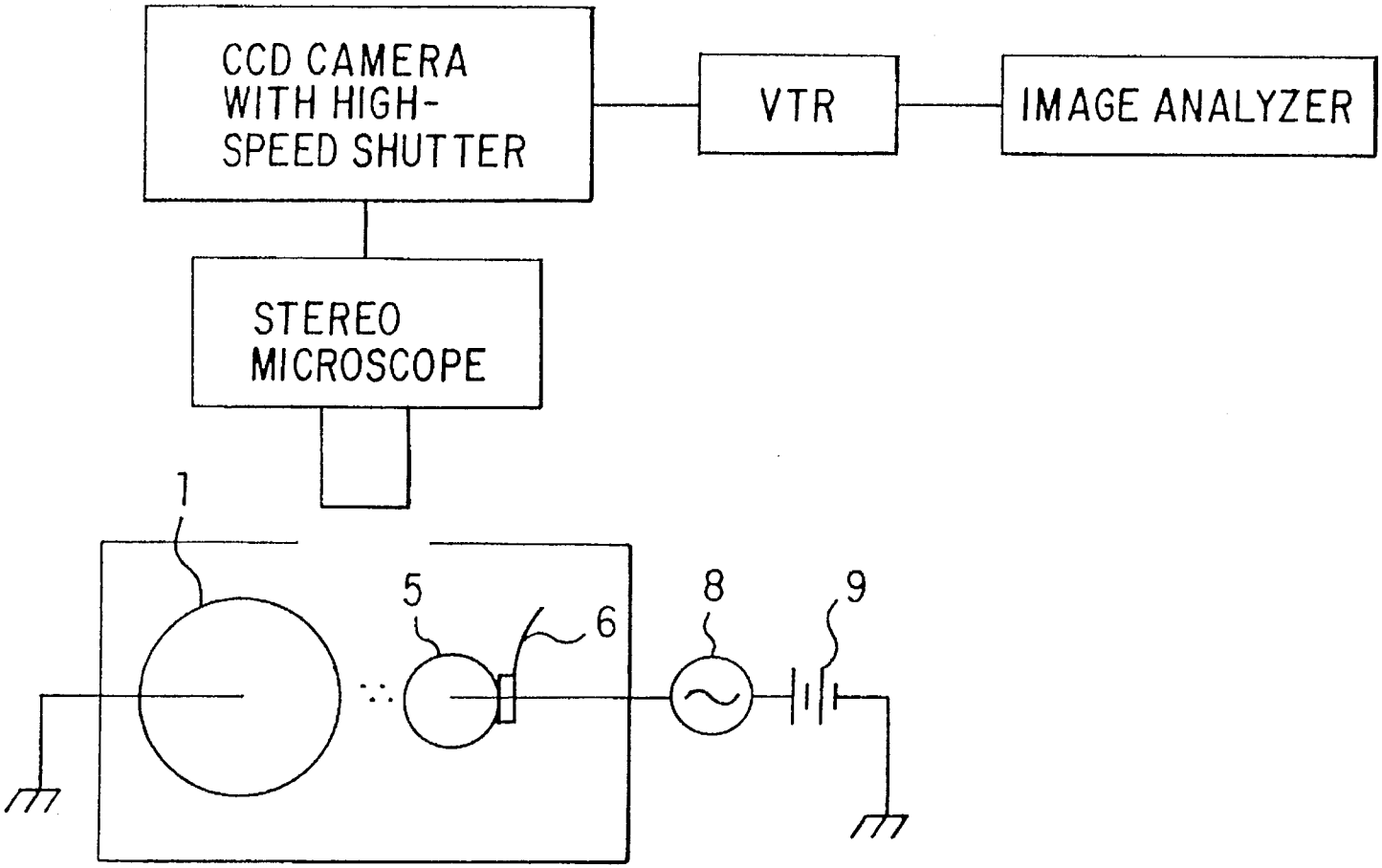
FIG. 2 is a view showing schematically a system for observing the aerial transfer of toner in the image developing region of the embodiment.

The parameters above were determined as follows: the system shown in FIG. 2 for observing the aerial transfer of toner was used to observe through a stereo microscope how toner was transferred aerially in the image developing process. The observations were videotaped and analyzed on an image analyzer. These procedures yielded a valuable collection of data for toner behavior analysis.

Figure 3:
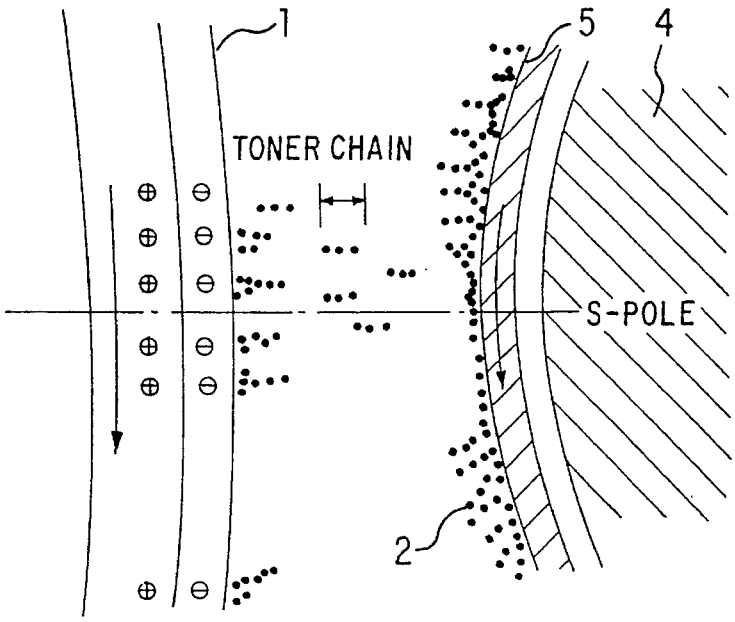
FIG. 3 is a conceptual view illustrating how the aerial transfer of toner takes place in the image developing region.

In the image developing process, toner was found to move aerially in a chain of links about 50 to 300 μm long each (called the toner chain). FIG. 3 shows conceptually how the aerial transfer of toner takes place in the image developing region of the apparatus. The observations under varying conditions revealed that the longer the toner chain link, the likelier the incidence of toner-induced blurs and blots of characters on each copy, and that the shorter the toner chain link, the likelier the incidence of solid density unevenness and scratchy characters.

Figure 4:
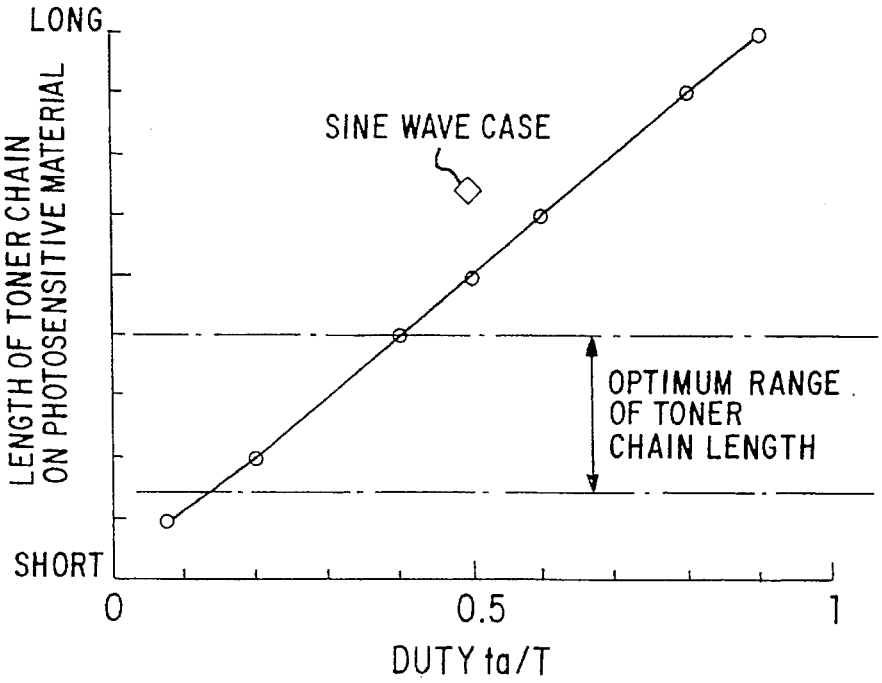
FIG. 4 is a graphic representation of a typical relationship between a duty ratio sawtooth waveform and the length of a toner chain.

The observations above led to two findings:

(1) Limiting the toner chain to a predetermined range provides effectively against the toner-induced blurs and blots of characters. FIG. 4 graphically depicts the appropriate toner chain range relative to the conventional (sine wave case) toner chain length.

(2) Optimizing the final weight of the aerially transferred toner in the image developing process (i.e., weight of toner on the image carrying member) primarily determines the solid density value. Following the revelations above, the inventors then ascertained the parameters determining the toner chain length and the preferred levels thereof through experiments. These parameters are described below in more detail.

Figure 5:
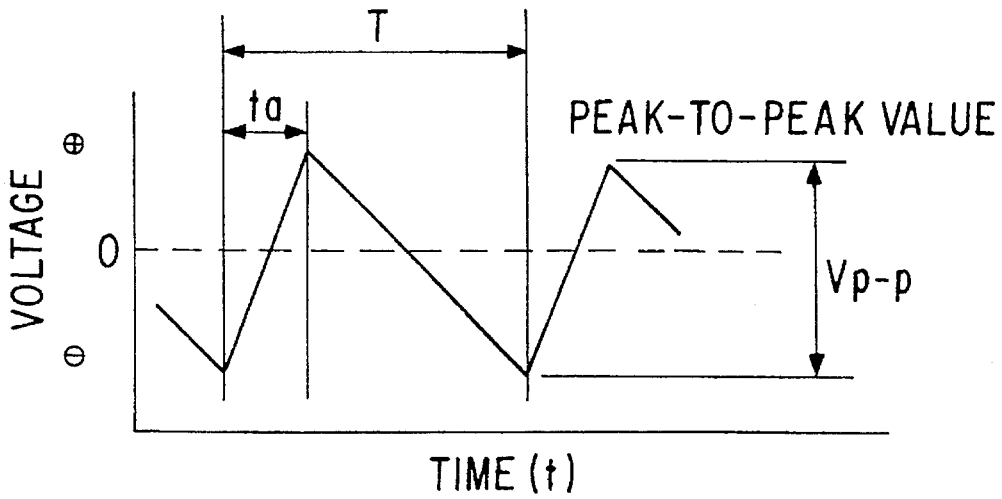
FIG. 5 is a graphic representation showing a developing bias waveform (sawtooth waveform) used by the embodiment.
Figure 6:
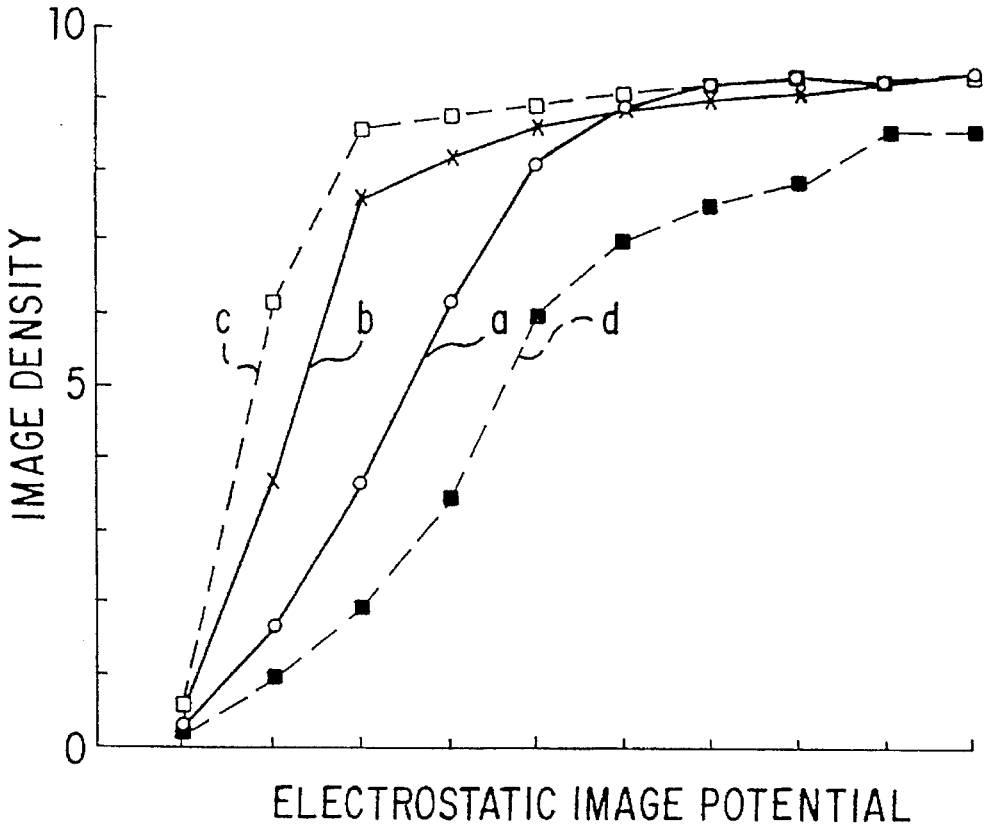
FIG. 6 is a graphic representation of different developing characteristics resulting from different electric resistance values of the developing sleeve.

(a) The aerial transfer of toner starting from the developing sleeve is controlled effectively using two parameters: developing bias waveform, and electric resistance value of the sleeve. The developing bias waveform is a sawtooth waveform in effect when the velocity of control is exceeded by the time (ta) in which to apply the electric field in he direction of promoting image development, i.e., in the direction of forcing the aerial transfer of toner from the developing sleeve to the photosensitive body surface. The duty ratio of the developing apparatus should preferably meet the condition $$ta/T \leqq 2/5$$

where, T represents one cycle of the developing bias waveform (sawtooth waveform) shown in FIG. 5. With this developing bias of the sawtooth waveform used in experiments, the sleeve of the typical conventional developing roller (with a resistance value of $10^9$ Ω) was compared in terms of developing characteristic (γ) with, among others, the sleeve disclosed in Japanese Patent Laid-open No. Hei 3-284771 (with a resistance value of $10^6$ Ω; resistance to leaks and dimensional stability are better than those of the former along with the more even electric resistance values), as illustrated in FIG. 6. In FIG. 6, the characteristic curve (a) of the latter sleeve (with the resistance of $10^6$ Ω) has a gentler gradient than that of the former sleeve (with the resistance of $10^9$ Ω) at the intermediate image density. At the saturated image density, the curve (a) of the latter sleeve is identical in gradient to the curve (b) of the former sleeve.

Also in FIG. 6, the curve (c) of another sleeve with a resistance value R of $10^{10}$ Ω or more has a poor gradient characteristic (i.e., developing characteristic γ too high); the sleeve reaches the saturation density at low potential levels. On the other hand, the curve (d) of yet another sleeve with a resistance value R of $10^4$ or less is subject to low saturation density levels; this sleeve tends to produce bias leaks. These observations led to the conclusion that the resistance R of the sleeve should optimally be between $10^5$ and $10^7$ Ω.

Figure 7:
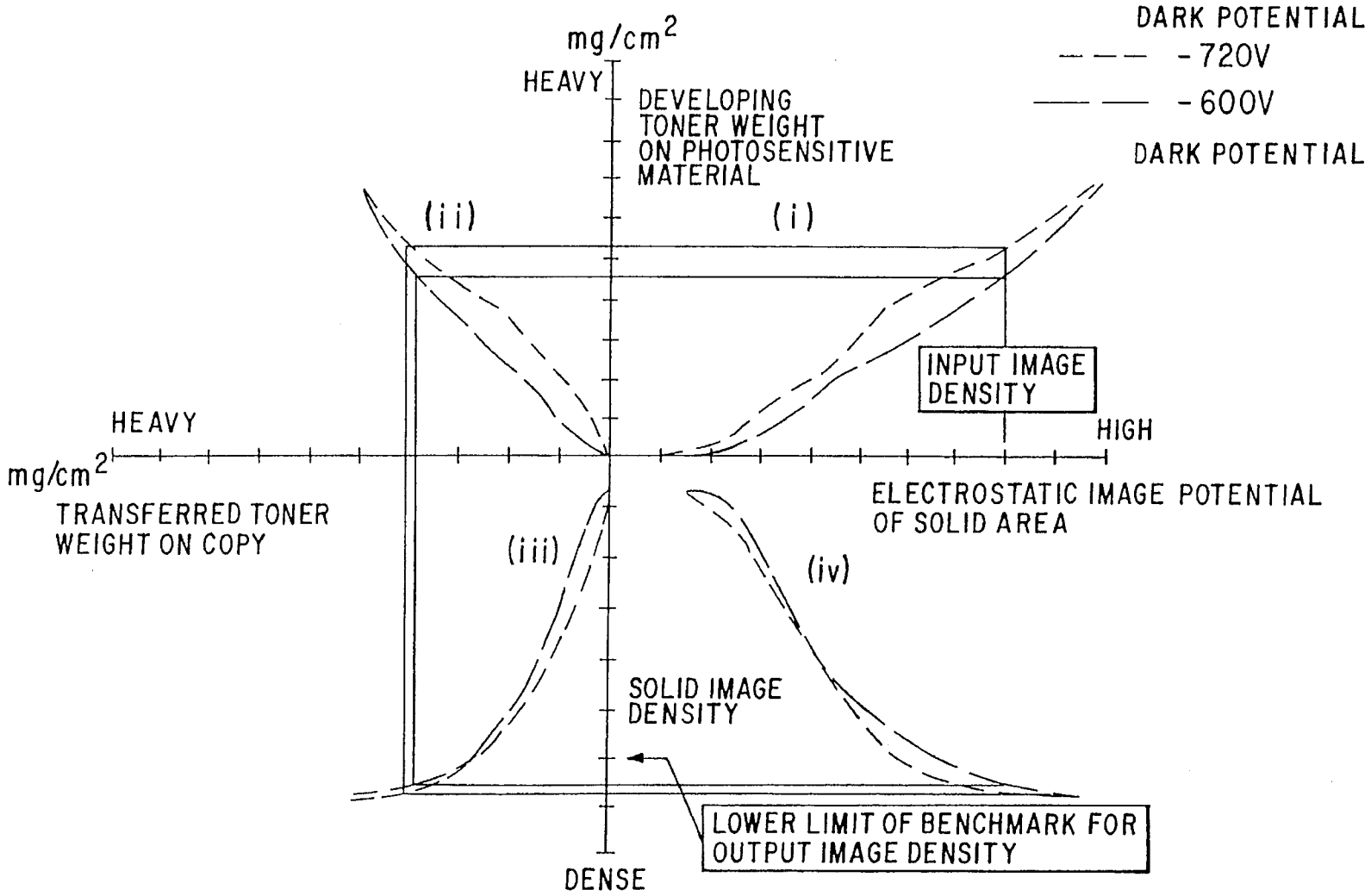
FIG. 7 is a quadrantal graphic representation showing typical characteristics of the electrostatic image potential of each solid area, the developing toner weight on a photosensitive material, the transferred toner weight on each copy and the solid image density, with dark potential in effect during copy-to-copy reproduction.

(b) A necessary and sufficient amount of aerially transferred toner is applied onto the photosensitive drum 1 by suitably controlling the dark developing potential $V_D$. This parameter is described in detail with reference to FIG. 7. FIG. 7 is a quadrantal graphic representation plotting data about (i) the electrostatic image potential of each solid area, (ii) the developing toner weight on the photosensitive material, (iii) the transferred toner weight on each copy, and (iv) the solid image density, in effect when copy-to-copy reproduction was performed on an original document with its solid area densities ranging from low to high contrast. In experiments, the dark potential $D_V$ was set to two levels: the conventional setting of minus 720 V, and the setting of 600 V for use on the embodiment of the invention (including the $10^6$ Ω sleeve with the sawtooth waveform).

The experiments proceeded as follows: the image density indicated as the factor (i) in the corresponding quadrant of FIG. 7 (e.g., the third highest solid area density) was first input as the image quality benchmark. The resultant data on the other three factors (ii), (iii) and (iv) were then obtained with respect to that benchmark under the two different conditions of potential. Regarding the factor (ii), copies showed different developing toner weights on the photosensitive material depending on the varying dark potential. These differences were reduced in the case of the factor (iii). With the factor (iv), the output image densities cleared the lower limit of the benchmark at both dark potential settings.

The experiments demonstrated that the conditions adopted by the invention satisfy the image quality requirements of the solid area density even on the final copy, without affecting in a significantly adverse manner the transfer and fixing processes even as the conventionally experienced excess development is reduced (by lowering the developing toner weight on the photosensitive material).

The inventors of this invention went on to examine the relationship between the gap G between the sleeve 5 and the image carrying member on the one hand, and the peak-to-peak voltage Vp-p of the above-described voltage waveform on the other. In experiments, the availability of image development was checked by varying the voltage Vp-p and the gap G. The results were summarized in FIG. 9 wherein a cross (x) represents a no-good state involving a leak of the developing bias voltage, an image density defect or other irregularities, and a circle (○) denotes the availability of a high quality image.

Figure 9:
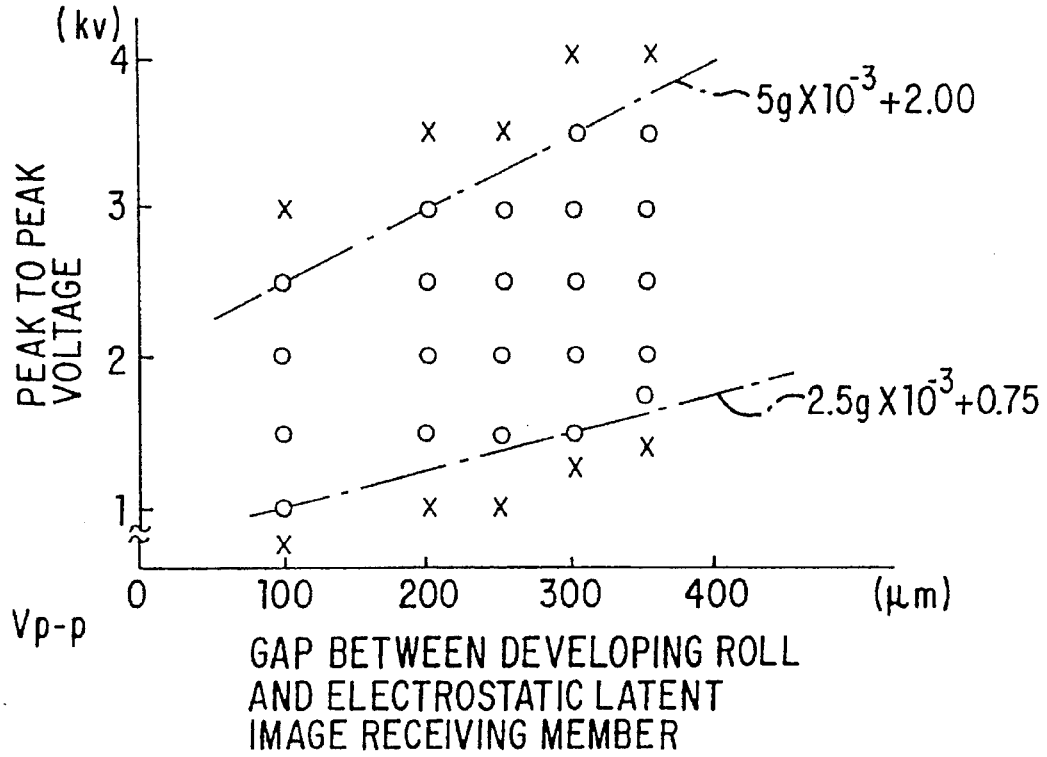
FIG. 9 is a graphic representation of a typical relationship between peak-to-peak voltages (Vp-p) applied on the one hand, and the gap between the sleeve and an electrostatic latent image receiving body on the other.

The results in FIG. 9 indicate that good images are available when the following condition is met:

$$2.5\times10^{-3}\ g+0.75 \leqq Vp\text{-}p \leqq 5\times10^{-3}\ g+2.0$$

where, g stands for a given gap and Vp-p is the voltage applied (kV). On the actual machine, the gap G was 250 μm or less and preferably 200 μm. The voltage Vp-p was thus selected to be 2.0 kHz as shown in FIG. 9.

Figure 10:
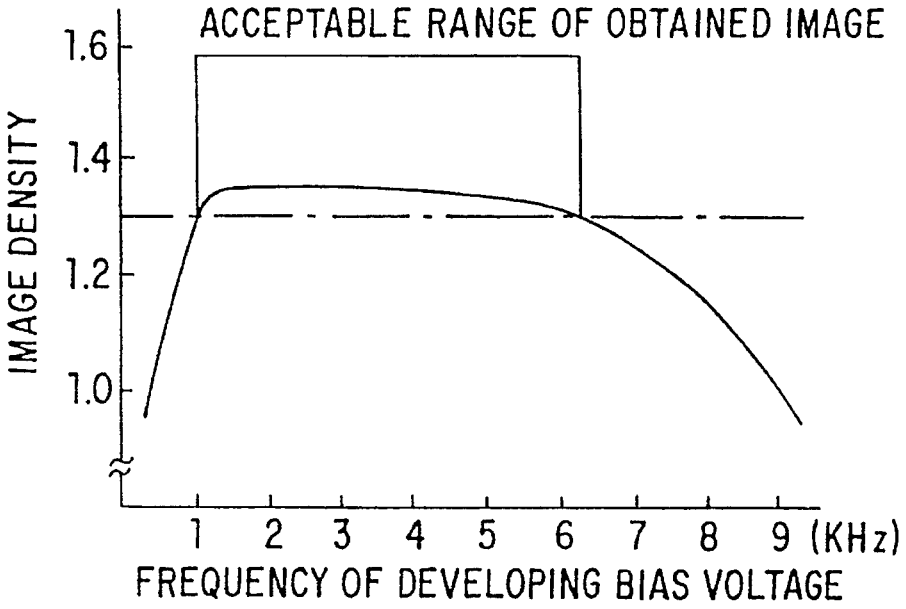
FIG. 10 is a graphic representation of a typical relationship between image densities obtained and the frequencies of the developing bias voltage applied.

The inventors then proceeded to check, within the range of the above voltage Vp-p, the relationship between the voltage frequency f (kHz) and the density of images. In experiments, the density of images was measured using a Macbeth illuminometer. The results of the measurements are plotted in FIG. 10. The results show that practically sufficient image densities are obtained as long as the voltage frequency f meets the following condition:

$$1.0(\text{kHz}) \leqq f \leqq 6.0(\text{kHz})$$

It is thought that below the lower limit of the above range, the toner 10 is not sufficiently transferred aerially and that above the upper limit, the aerial transfer of the toner 10 fails to follow the change in the electric field.

Observation of the aerial transfer of the toner chain indicated that the dark potential $D_V$ of minus 600 V falls within the optimum range shown in FIG. 3. Another condition used by the invention is the peak-to-peak value of the developing bias. The optimum peak-to-peak value is found to be 2000 V, a value which ensures good resistance to leaks of the developing sleeve while maintaining sufficient image quality. The improved dimensional stability of the sleeve adopted by the invention allows the gap between the sleeve and the photosensitive drum to be set more narrowly than ever before. In addition, with the sawtooth waveform of the developing bias in use, the same peak-to-peak value provides better resistance of the bias voltage to leaks than if the ordinary sine wave is used.

Figure 8:
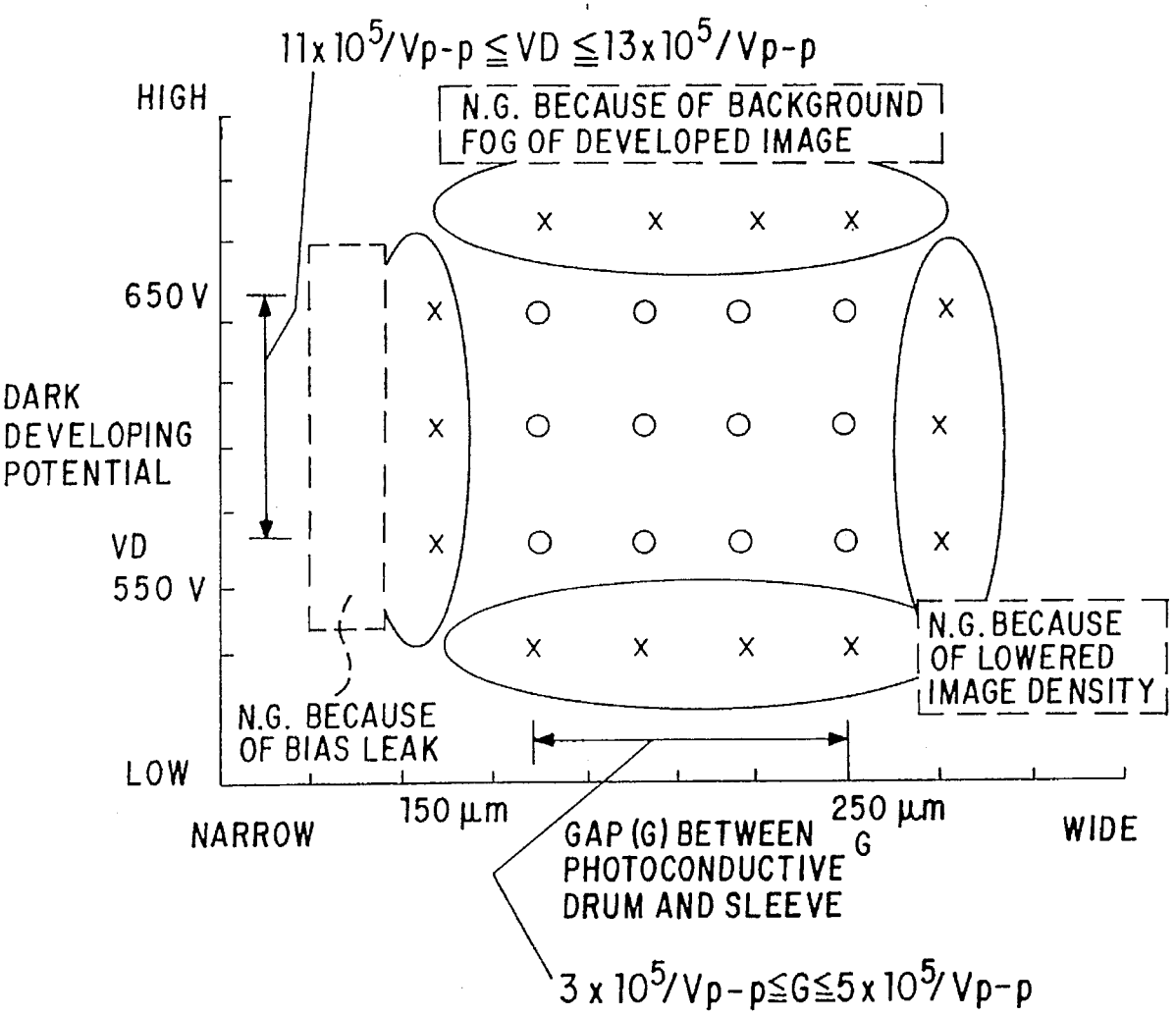
FIG. 8 is a view depicting how developed images are affected by the dark developing potential and by the gap between a photoconductive drum and the sleeve.

The inventors of this invention did more experiments under the above-described conditions. The results are shown in FIG. 8. According to the experiments and as indicated in FIG. 8, when the dark developing potential $V_D$ exceeded $13\times10^5$/Vp-p, the developed images entailed a background fog; when the potential $V_D$ was lower than $11\times10^5$/Vp-p, the image density dropped too low. When the gap G between the photoconductive drum 1 and the sleeve 5 was narrower than $3\times10^5$/Vp-p, bias leaks occurred; when the gap G exceeded $5\times10^5$/Vp-p, the toner chains failed to develop and no copying was available.

Good results were obtained when the same experiments were carried out in certain ranges of values, which are shown below as preferable ranges (optimum ranges in parentheses):

$1.25\ \text{kV} \leqq \text{Vp-p} \leqq 3.0\ \text{kV}\ (1.5 \leqq \text{Vp-p} \leqq 2.5)$ $100\ \mu\text{m} \leqq G \leqq 350\ \mu\text{m}\ (150 \leqq G \leqq 250\ \mu\text{m})$ $-550\ \text{V} \leqq \text{Vp} \leqq -650\ \text{V}$ (none)

$1.0\ \text{kHz} \leqq f \leqq 6\ \text{kHz}\ (1.5 \leqq f \leqq 4\ \text{kHz})$ As described, the developing apparatus using monocomponent developer according to the invention allows the connected copier to raise the level of shadow and line image reproducibility while maintaining the current level of black area reproducibility. In so doing, the inventive apparatus reduces density irregularities and reinforces the resistance to leaks.

As many apparently different embodiments of this invention may be made without departing from the spirit and scope thereof, it is to be understood that the invention is not limited to the specific embodiments thereof except as defined in the appended claims.

What is claimed is:

1. A developing apparatus using monocomponent developer comprising:

developer application means for having a thin coat of monocomponent magnetic developer of a constant thickness applied to and held over a developer carrying body, the thin coat on said developer carrying body being moved close to an image carrying member;

transfer means for getting an alternating electric field applied between said developer carrying body and said image carrying member to transfer aerially said thin coat of monocomponent magnetic developer from said developer carrying body to said image carrying member; and developing means for developing a latent image on said image carrying member using the transferred developer;

wherein the following conditions are met:

$$11\times10^5/Vp\text{-}p \leqq V_D \leqq 13\times10^5/Vp\text{-}p$$

$$3\times10^5/Vp\text{-}p \leqq G \leqq 5\times10^5/Vp\text{-}p$$

where, $V_D$ stands for the dark developing potential in volts for the image developing region of said developing apparatus, Vp-p for the peak-to-peak value of said alternating electric field, and G for the gap in microns between said developer carrying body and said image carrying member.

2. A developing apparatus using monocomponent developer according to claim 1, wherein said developer carrying body is a cylindrical body of which the circumference is covered with a semiconductive layer and which incorporates a magnet roll inside, and wherein the following condition is met:

$$10^5 \leqq R \leqq 10^7$$

where, R represents the electric resistance value of said semiconductive layer in units of Ω·cm.

3. A developing apparatus using monocomponent developer according to claim 1, wherein the following condition is met:

k $$ta/T \leqq 2/5$$

where, ta/T stands for the duty ratio of said developing apparatus, T for the period of said alternating electric field, and ta for the time in which to apply said alternating electric field for promoting development.

* * * * *